US009512644B2

(12) United States Patent
Lambrou et al.

(10) Patent No.: US 9,512,644 B2
(45) Date of Patent: Dec. 6, 2016

(54) LOCK ASSEMBLY

(75) Inventors: Harris Lambrou, Blackburn (AU); Stuart Clark, Blackburn (AU)

(73) Assignee: Gainsborough Hardware Industries Limited, Blackburn, Victoria (AU)

( * ) Notice: Subject to any disclaimer, the term of this patent is extended or adjusted under 35 U.S.C. 154(b) by 74 days.

(21) Appl. No.: 13/990,549

(22) PCT Filed: Feb. 22, 2012

(86) PCT No.: PCT/AU2012/000171

§ 371 (c)(1),
(2), (4) Date: Jun. 13, 2013

(87) PCT Pub. No.: WO2012/119184

PCT Pub. Date: Sep. 13, 2012

(65) Prior Publication Data

US 2013/0340491 A1 Dec. 26, 2013

(30) Foreign Application Priority Data

Mar. 8, 2011 (AU) ..... 2011900822

(51) Int. Cl.

| | |
|---|---|
| ***E05B 49/00*** | (2006.01) |
| ***E05B 47/00*** | (2006.01) |
| ***E05B 47/02*** | (2006.01) |
| ***E05B 63/04*** | (2006.01) |
| *E05B 15/02* | (2006.01) |

(Continued)

(52) U.S. Cl.

CPC ..... *E05B 47/0001* (2013.01); *E05B 47/0012* (2013.01); *E05B 47/026* (2013.01); *E05B 63/04* (2013.01); *E05B 15/02* (2013.01); *E05B 17/22* (2013.01); *E05B 63/0056* (2013.01); *E05B 2001/0076* (2013.01);

(Continued)

(58) Field of Classification Search

CPC .. E05B 47/0001; E05B 47/06; E05B 47/0603; E05B 51/00; E05B 2047/0048; E05B 2047/005; E05B 2047/0051; E05B 2047/0054; E05B 2047/0067; E05B 2047/0068

USPC ..... 70/275, 277, 278.1, 278.2, 278.3, 278.7,70/280, 281, 282, 283.1

See application file for complete search history.

(56) References Cited

U.S. PATENT DOCUMENTS 3,673,562 A 6/1972 Buell
4,021,065 A * 5/1977 Geringer ..... 70/281
(Continued)

FOREIGN PATENT DOCUMENTS

WO 2006/016826 A2 2/2006

OTHER PUBLICATIONS

Australian Patent Office; Search Report in International Patent Application No. PCT/AU2012/000171 dated Mar. 22, 2012; 2 pages.

*Primary Examiner* — Christopher Boswell
(74) *Attorney, Agent, or Firm* — Wood Herron & Evans LLP

(57) ABSTRACT

A lock assembly (10) including an orientation sensor (26) and at least one component operable in two modes (32). The orientation sensor (26) is adapted to indicate at least two orientations of the orientation sensor (26). The at least one component (32) is operable in a predetermined one of the at least two modes responsive to an indication of one of the at least two orientations from the orientation sensor (26) and is operable in a predetermined other of the at least two modes responsive to an indication of the other of the at least two orientations from the orientation sensor (26).

27 Claims, 4 Drawing Sheets

(51) Int. Cl.
*E05B 17/22* (2006.01)
*E05B 63/00* (2006.01)
*E05B 1/00* (2006.01)

(52) U.S. Cl.
CPC ..... *E05B 2047/0048* (2013.01); *E05B 2047/0058* (2013.01); *E05B 2047/0067* (2013.01); *Y10T 70/7062* (2015.04)

(56) References Cited

U.S. PATENT DOCUMENTS 6,967,562 B2 * 11/2005 Menard ..... E05B 45/06 292/346
7,373,795 B2 * 5/2008 Kilbourne ..... E05B 47/0012 292/244
8,490,445 B2 * 7/2013 Chiou ..... E05B 47/0012 70/224
8,621,900 B2 * 1/2014 Wu ..... E05B 47/026 292/142
9,322,195 B2 * 4/2016 Ainley ..... E05B 47/0001
2001/0028232 A1 10/2001 Koerwer
2004/0039920 A1 * 2/2004 Kim et al. ..... 713/185
2007/0056338 A1 * 3/2007 Sabo et al. ..... 70/257
2007/0169525 A1 * 7/2007 Chang ..... E05B 47/068 70/472
2008/0236214 A1 * 10/2008 Han ..... 70/129
2009/0193859 A1 * 8/2009 Kwon et al. ..... 70/91
2009/0211320 A1 * 8/2009 Wu ..... E05B 47/0012 70/277
2011/0066288 A1 * 3/2011 Sparenberg et al. ..... 700/275
2011/0148631 A1 * 6/2011 Lanham ..... E02D 29/14 340/540
2011/0203331 A1 8/2011 Picard et al.
2011/0259059 A1 * 10/2011 Wu ..... E05B 47/0012 70/91
2012/0167646 A1 * 7/2012 Sharma et al. ..... 70/280
2013/0219975 A1 * 8/2013 Ainley ..... E05B 47/0001 70/279.1
2014/0190083 A1 * 7/2014 Lepie ..... 49/30

* cited by examiner

LOCK ASSEMBLY

FIELD OF THE INVENTION

The present invention relates to a lock assembly.

The invention has been primarily developed in relation to a lock assembly for a door and will be described here in after with reference to that application. However, the invention can also be used in other types of lock assemblies, including surface mounted locks.

BACKGROUND OF THE INVENTION

Electrically controllable locks are known which use one or more electric actuators to retract or allow the user to retract a latch and/or lock bolt into the lock assembly for door opening. Electrically controllable locks are also known which use sensors to internally monitor their status or allow an external control switch to monitor the lock status. These types of locks can be mounted to a left handed door (i.e. hinges on the left hand side) or a right handed door (i.e. hinges on the right hand side). The way the actuator(s) operate differs depending on whether the lock is mounted on a left hand or right hand door. Similarly, the meaning of the sensor information differs depending on whether the lock is mounted on a left hand or right hand door.

Such locks can include a switch or other mechanism which can be set by the lock installer to ensure that the lock operation is as desired on a left or right handed door. This saves the lock manufacturer from having to make, stock and sell two different locks, one for left handed doors and one for right handed doors. However, this also places an onus on the installer to set the switch correctly. A disadvantage of such locks is that the installer can incorrectly set the switch or, after not having read the instructions, not set the switch at all. This can cause one or more locks in an installation to not behave as desired, necessitating time and expense to identify and correct the problem.

OBJECT OF THE INVENTION

It is the object of the present invention to substantially overcome or at least ameliorate one or more of the above disadvantages.

SUMMARY OF THE INVENTION

Accordingly, in a first aspect, the present invention provides a lock assembly including:

an orientation sensor adapted to indicate at least two orientations of the orientation sensor; and at least one component operable in at least two modes, the at least one component being operable in a predetermined one of the at least two modes responsive to an indication of one of the at least two orientations from the orientation sensor and being operable in a predetermined other of the at least two modes responsive to an indication of the other of the at least two orientations from the orientation sensor.

Preferably, the orientation sensor is adapted to indicate two orientations of the orientation sensor and the at least one component is operable in two modes, wherein the to at least one component is operable in a predetermined one of the two modes responsive to an indication of one of the two orientations from the orientation sensor and being operable in a predetermined other of the two modes responsive to an indication of the other of the two orientations from the orientation sensor.

The lock assembly preferably includes a controller adapted to operate the at least one component in a selected one of the least two modes responsive to the indication from the orientation sensor. In one form, the lock assembly includes a housing containing the orientation sensor, the at least one component and the controller. In another form, the controller forms part of an external access system.

The orientation sensor is preferably a tilt switch, most preferably adapted to indicate two orientations of the tilt switch. In one form, the tilt switch is preferably adapted for determining whether a first or a second and opposite side of the lock assembly is adjacent a free (ie. non-hinged) edge of a door. In another form, the tilt switch is preferably adapted for determining whether a first or a second and opposite side of the lock assembly is upwardly facing or downwardly facing.

The at least one component is preferably a motor, most preferably adapted for driving a latch or lock bolt.

The lock assembly preferably includes a control component installable in at least two orientations. The control component preferably includes a printed circuit board (PCB). The orientation sensor is preferably associated with the control component The orientation sensor is preferably mounted on the PCB. The lock assembly preferably includes a housing for the control component. The housing is preferably also adapted for for storage of at least one battery or other power source.

In a second aspect, the present invention provides a lock arrangement including:

an orientation sensor adapted to indicate at least two orientations of the orientation sensor; and a controller adapted to interpret data, or control at least one lock component, in at least a first way responsive to an indication of one of the at least two orientations from the orientation sensor and in at least a second way responsive to an indication of the other of the at least two orientations from the orientation sensor.

Preferably, the orientation sensor is adapted to indicate two orientations of the lock assembly and the controller is adapted to interpret data, or control a lock component, in a first way responsive to an indication of one the two orientations from the orientation sensor and in a second way responsive to an indication of the other of the two orientations from the orientation sensor.

The orientation sensor is preferably a tilt switch, most preferably adapted to indicate two orientations of the tilt switch. In one form, the tilt switch is preferably adapted for determining whether a first or a second and opposite side of the lock assembly is adjacent a free (ie. non-hinged) edge of a door. In another form, the tilt switch is preferably adapted for determining whether a first or a second and opposite side of the lock assembly is upwardly facing or downwardly facing.

The at least one component is preferably a motor, most preferably adapted for driving a latch or lock bolt.

In a third aspect, the present invention provides a method of controlling a lock assembly including:

determining which one of at least two orientations an orientation sensor associated with the lock assembly is in; and controlling at least one component in the lock assembly to operate in a selected one of at least two modes responsive to the determination of the one of the at least two orientations with the orientation sensor and in a selected other of at least two modes responsive to the determination of the other of the at least two orientations with the orientation sensor.

In a fourth aspect, the present invention provides a method of controlling a lock arrangement including:

determining which one of at least two orientations an orientation sensor associated with the lock assembly is in; and interpreting data, or controlling at least one lock component, in at least a first way responsive to an indication of one of the at least two orientations from the orientation sensor and in at least a second way responsive to an indication of the other of the at least two orientations from the orientation sensor.

BRIEF DESCRIPTION OF THE DRAWINGS

A preferred embodiment will now be described, by way of an example only, with reference to the accompanying drawings, in which.

DETAILED DESCRIPTION OF THE PREFERRED EMBODIMENTS

Figure 1:
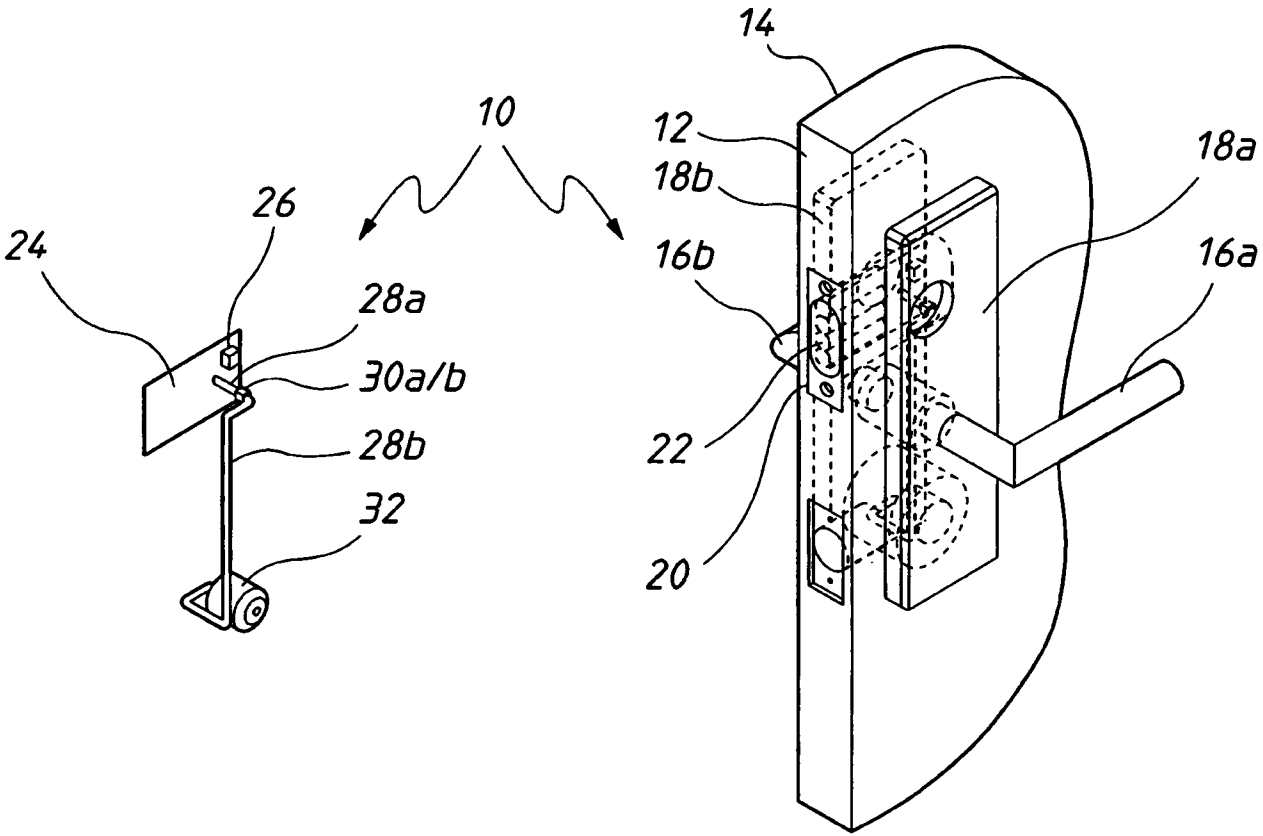
FIG. 1 is an partially exploded perspective view of first embodiment of a lock assembly.

FIG. 1 shows a first embodiment of a surface mounted lock assembly, indicated generally by the reference numeral 10. The lock assembly 10 is shown mounted adjacent an edge 12 of a door 14. The lock assembly includes a pair of handles 16*a* and 16*b*, a pair of escutcheons 18*a* and 18*b* and a housing 20 for storage of batteries 22 and other components as will be described in more detail below.

FIG. 1 also shows a printed circuit board (PCB) 24 on which is mounted an orientation sensor, in the form of a tilt switch 26. A first cable part 28*a* extends from the the PCB 24 to a first connector part 30*a*. A second cable part 28*b* extends from a second connector part 30*b* to an electric motor 32. The motor 32 is able to operate in two modes, a first mode being rotation in a first direction and a second mode being rotation in a second opposite direction.

Figure 2:
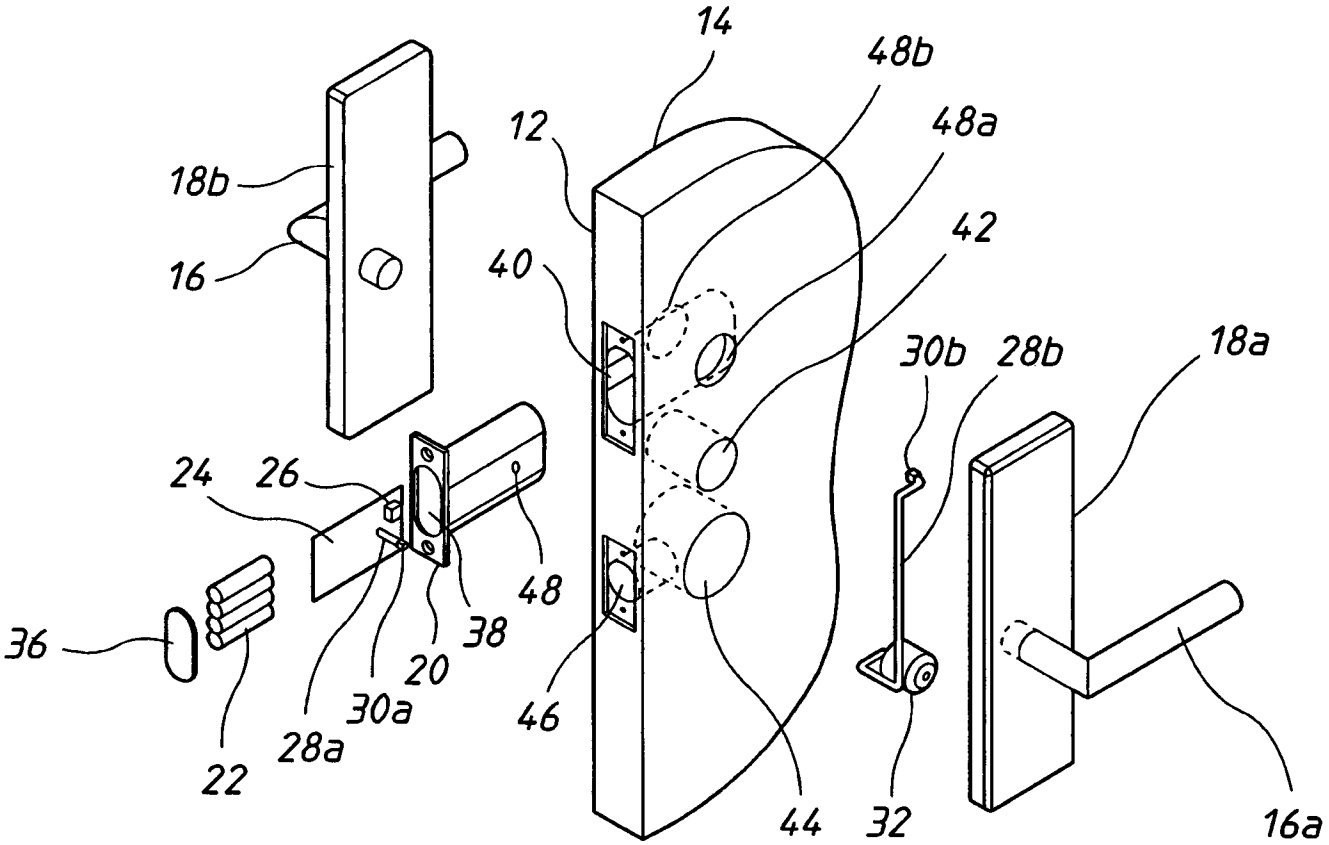
FIG. 2 is a fully exploded perspective view of the lock assembly shown in FIG. 1.

FIG. 2 shows more clearly that the housing 20 includes a lid 36 for a recess 38 that locates the batteries 22 and the PCB 24.

FIG. 2 also shows that the door 14 includes a recess 40 for the housing 20, a recess 42 for a shaft (not shown) that extends between the handles 16*a* and 16*b*, a recess 44 for the motor 32 and a recess 46 for a lock or latch bolt (not shown).

The housing 20 includes an opening 48 through which the first connector part 30*a*, associated with the PCB 24, and the second connector part 30*b*, associated with the motor 32, can be connected. The door 14 includes a pair of corresponding openings 48*a* and 48*b* which allow the connector parts 30*a* and 30*b* to be connected regardless of the side of the door 14 in which the second cable part 30*b* and the motor 32 are located.

Figures 3, 4, 5, 6:
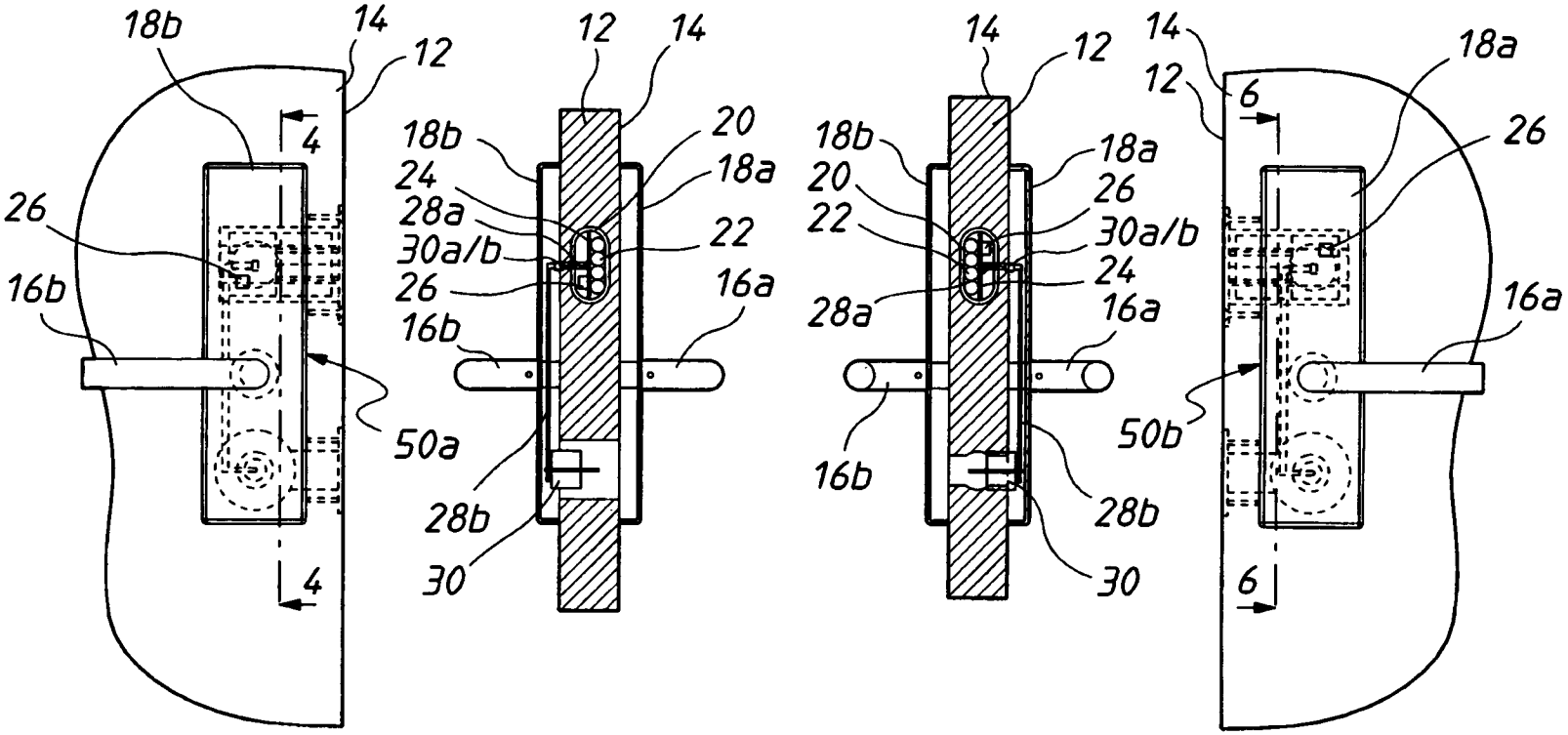
FIG. 3 is a front view of the lock assembly FIG. 1, installed in a left handed door.
FIG. 4 is a cross sectional end view along line 4-4 of the lock assembly shown in FIG. 3.
FIG. 5 is a front view of the lock assembly of FIG. 1 installed in a right handed door.
FIG. 6 is a cross sectional end view along line 6-6 of the lock assembly shown in FIG. 5.

FIGS. 3 and 4 show the above components mounted in a left handed door. Lock installers are aware that any cable extending from the housing 20 should be positioned relatively inwardly from the door edge 12 which, in the installation shown, positions the connector parts 30*a* and 30*b* and the cable part 28*b* within the left side escutcheon 18*b*.

FIGS. 5 and 6 show how the components are installed in a right handed door with the connector parts 30*a* and 30*b* and the cable part 28*b* within the right side escutcheon 18*a*.

As the tilt switch 26 is relatively inverted between these two possible installations, the tilt switch 26 provides a differentiation of the motor 32 having to function in a left handed door or a right handed door. The PCB 24 then provides an appropriate signal to control the motor 32 to drive in a first direction to retract a bolt in a left handed door and in a second opposite direction to retract a bolt in a right handed door.

As a result, the lock installer does not have to set any mechanisms or controllers in order to cause the motor 32 to rotate in the correct direction for bolt retraction, as the tilt switch provides an indication of left handed or right handed installation and causes the motor 32 to be controlled appropriately. This advantageously avoids locks being installed with an incorrect motor direction and any resulting inconvenience, lack of security, unintentional confinement and/or a requirement for the lock installation to be subsequently corrected.

Figure 8:
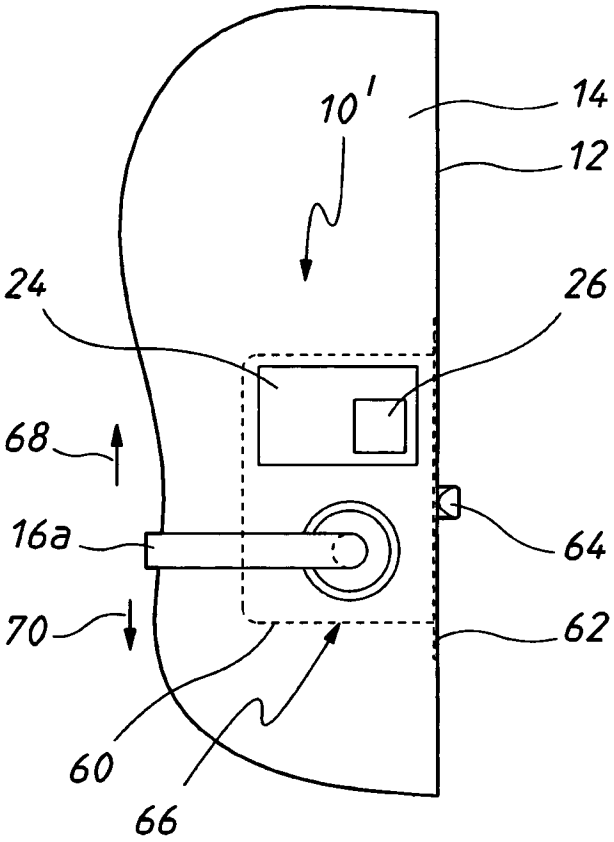
FIG. 8 is a front view of the lock assembly of FIG. 7 installed in a right handed, door in an inverted orientation compared to the orientation of FIG. 7.
Figure 7:
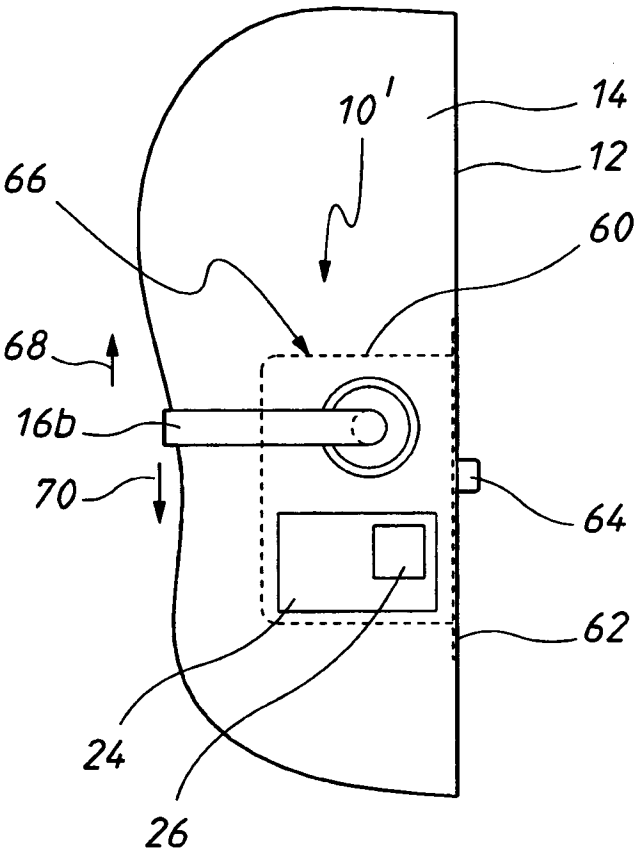
FIG. 7 is a front view of a second embodiment of a lock assembly installed in a left handed door.

FIGS. 7 and 8 show a second embodiment of a lock assembly, indicated by the reference numeral 10'. The lock assembly 10' is somewhat similar to the lock assembly 10 shown in FIGS. 1 to 6 and like features have been indicated with like reference numerals. The lock assembly 10' is of the mortice type and includes a housing 60 installed in a recess in the door 14. The housing 60 includes a face plate 62 through which protrudes a bolt 64.

With reference to FIG. 7, the lock assembly 10' is shown installed with a side 66 of the housing 60 facing upwards. In this orientation, the internal lever 16*b* is moved upwardly, as indicated by arrow 68, to lock the door 14 by preventing movement of the external lever (not shown), and is moved downwardly, as indicated by arrow 70, to unlock the door 14, by permitting movement of the external lever and allowing retraction of the bolt 64 for door opening. If the lock assembly 10' was mounted with the side 66 of the housing 60 facing downwards, then moving the internal handle 16*b* upwardly would unlock the door 14 and moving the internal handle 16*b* downwardly would lock the door. This is both inconvenient and confusing for users.

However, and as shown in FIG. 8, when the lock assembly 10' is inverted, such that the housing edge 66 is facing downwards, the orientation sensor 26 is also then relatively inverted. The orientation sensor 26 then issues a signal to components (not shown) that are operable in response to movement of the internal lever 16*a* such that they reconfigure so that moving the lever handle 16*a* upwardly (correctly) locks the door 14 and moving the lever 16*a* downwardly (correctly) unlocks the door 14.

The above operation can be carried out with the orientation sensor 26 providing a differentiation to the components between the internal and external levers and the bolt, appropriate to the correct functionality in a left handed door or a right handed door. Alternatively, the orientation sensor 26 can issue a signal to an external controller, is forming part of an external access system, and the access system can appropriately influence the operation of the internal components of the lock assembly 10'.

Although the invention has been described with reference to a preferred embodiment, it will be appreciated by a person skilled in the art that the invention may be embodied in many other forms.

The invention claimed is:

1. A lock assembly operable in both a right-handed door and a left-handed door, said lock assembly comprising:

an orientation sensor adapted to indicate at least two spatial orientations of the orientation sensor; and at least one component operable in at least first and second modes, the at least one component being operable in the first mode for use in the right-handed door in response to an indication of one of the at least two spatial orientations from the orientation sensor before or during installation of said lock assembly and being operable in the second mode for use in the left-handed door in response to an indication of the other of the at least two spatial orientations from the orientation sensor before or during installation of said lock assembly;

wherein the indication of one of the at least two spatial orientations from the orientation sensor is automatic without actuation of the lock assembly.

2. The lock assembly as claimed in claim 1, wherein the orientation sensor is adapted to indicate two spatial orientations of the orientation sensor.

3. The lock assembly as claimed in claim 1, further including a controller adapted to operate the at least one component in a selected one of the at least first and second modes responsive to the indication from the orientation sensor.

4. The lock assembly as claimed in claim 3, wherein the lock assembly includes a housing containing the orientation sensor, the at least one component and the controller.

5. The lock assembly as claimed in claim 3, wherein the controller forms part of an external access system.

6. The lock assembly as claimed in claim 1, wherein the orientation sensor is a tilt switch.

7. The lock assembly as claimed in claim 6, wherein the tilt switch is adapted to indicate two orientations of the tilt switch.

8. The lock assembly as claimed in claim 6, wherein the tilt switch is adapted for determining whether a first or a second and opposite side of the lock assembly is adjacent a free edge of the door.

9. The lock assembly as claimed in claim 6, wherein the tilt switch is adapted for determining whether a first or a second and opposite side of the lock assembly is upwardly facing or downwardly facing.

10. The lock assembly as claimed in claim 1, wherein the at least one component is a motor.

11. The lock assembly as claimed in claim 10, wherein the motor is adapted for driving a latch or lock bolt.

12. The lock assembly as claimed in claim 1, further including a control component installable in at least two orientations.

13. The lock assembly as claimed in claim 12, wherein the control component includes a printed circuit board.

14. The lock assembly as claimed in claim 12, wherein the orientation sensor is associated with the control component.

15. The lock assembly as claimed in claim 12, wherein the orientation sensor is mounted on the printed circuit board.

16. The lock assembly as claimed in claim 12, further including a housing for the control component.

17. The lock assembly as claimed in claim 16, wherein the housing is also adapted for storage of at least one battery or other power source.

18. A lock arrangement operable in both a right-handed door and a left-handed door, said lock arrangement comprising:

an orientation sensor adapted to indicate at least two spatial orientations of the orientation sensor; and a controller adapted to interpret data, or control at least one lock component, in at least a first way, for use in the right-handed door, responsive to an indication of one of the at least two spatial orientations from the orientation sensor before or during installation of said lock arrangement and in at least a second way, for use in the left-handed door, responsive to an indication of the other of the at least two spatial orientations from the orientation sensor before or during installation of said lock arrangement;

wherein the indication of one of the at least two spatial orientations from the orientation sensor is automatic without actuation of the lock arrangement.

19. The lock arrangement as claimed in claim 18, wherein the orientation sensor is adapted to indicate two spatial orientations of the orientation sensor.

20. The lock arrangement as claimed in claim 18, wherein the orientation sensor is a tilt switch.

21. The lock arrangement as claimed in claim 20, wherein the tilt switch is adapted to indicate two spatial orientations of the tilt switch.

22. The lock arrangement as claimed in claim 20, wherein the tilt switch is adapted for determining whether a first or a second and opposite side of the lock assembly is adjacent a free edge of the door.

23. The lock arrangement as claimed in claim 20, wherein the tilt switch is adapted for determining whether a first or a second and opposite side of the lock assembly is upwardly facing or downwardly facing.

24. The lock arrangement as claimed in claim 18, wherein the at least one lock component is a motor.

25. The lock arrangement as claimed in claim 24, wherein the motor is adapted for driving a latch or lock bolt.

26. A method of controlling a lock assembly operable in both a right-handed door and a left-handed door, said method comprising:

determining which one of at least two spatial orientations an orientation sensor associated with the lock assembly is in; and controlling at least one component in the lock assembly to operate in a first mode for use in the right-handed door in response to the determination of the one of the at least two spatial orientations from the orientation sensor before or during installation of said lock assembly and in a second mode for use in the left-handed door in response to the determination of the other of the at least two spatial orientations from the orientation sensor before or during installation of said lock assembly;

wherein the determination of one of the at least two spatial orientations from the orientation sensor is automatic without actuation of the lock assembly.

27. A method of controlling a lock arrangement operable in both a right-handed door and a left-handed door, said method comprising:

determining which one of at least two spatial orientations an orientation sensor associated with the lock arrangement is in; and interpreting data, or controlling at least one lock component, in at least a first way, for use in the right-handed door, responsive to an indication of one of the at least two spatial orientations from the orientation sensor before or during installation of said lock arrangement and in at least a second way, for use in the left-handed door, responsive to an indication of the other of the at least two spatial orientations from the orientation sensor before or during installation of said lock arrangement;

wherein the indication of one of the at least two spatial orientations from the orientation sensor is automatic without actuation of the lock arrangement.

* * * * *